US005189749A

United States Patent [19]

Thomas et al.

[11] Patent Number: 5,189,749

[45] Date of Patent: Mar. 2, 1993

[54] MULTIPURPOSE BROADHEAD AND ARROW MAINTENANCE TOOL

[75] Inventors: Bruce A. Thomas, Swartz Creek; Mark A. Smith; Mark T. Birchmeier, both of Owosso; Lawrence D. Reiber, Oakley, all of Mich.

[73] Assignee: Thomas Design & Engineering Services, Inc., Swartz Creek, Mich.

[21] Appl. No.: 845,201

[22] Filed: Mar. 3, 1992

[51] Int. Cl.[5] ..... B25B 13/00

[52] U.S. Cl. ..... 7/138; 7/170; 51/205 R; 51/205 WG; 76/88; 81/121.1; 81/176.15

[58] Field of Search ..... 7/106, 138, 169, 170; 51/205 R, 205 WG, 391, 392; 76/88; 81/121.1, 176.15, 176.2, 186

[56] References Cited

U.S. PATENT DOCUMENTS

| | | | |
|---|---|---|---|
| 3,797,334 | 3/1974 | Sinclair | 76/88 |
| 4,069,528 | 1/1978 | Newton et al. | 7/170 |
| 4,974,273 | 12/1990 | Buttermore et al. | 7/138 X |

*Primary Examiner*—James G. Smith
*Attorney, Agent, or Firm*—James C. McLaughlin

[57] ABSTRACT

A multipurpose tool for maintaining hunting arrows is disclosed. The tool is a sharpener capable of sharpening broadheads, a wrench capable of tightening or loosening broadheads screwed onto an arrow, and a dresser capable of dressing the fletched end of an arrow so that the arrow effectively will receive a nock. The tool has an elongated body with integral longitudinal ridges to enhance its appearance and to facilitate gripping, and is preferably molded of ABS plastic in two pieces. The sharpener and wrench are at the bottom, and the dresser is at the top of the tool. The sharpener comprises a shallow channel running diagonally across the face of the bottom, normal to the axis of the tool, with a plurality of small hard rods imbedded in the sides of the groove. Sharpening is effected by movement of the edge of a broadhead along the shallow groove. The wrench comprises a plurality of deep grooves extending radially from the axis of the tool with the deep grooves arranged so that they will receive the broadhead of an arrow that is coaixal to the tool. The dresser comprises a conical recess formed by a plurality of ribs with a hard blade imbedded in at least one of the ribs. The blade has a flat edge.

20 Claims, 4 Drawing Sheets

Figure 3A
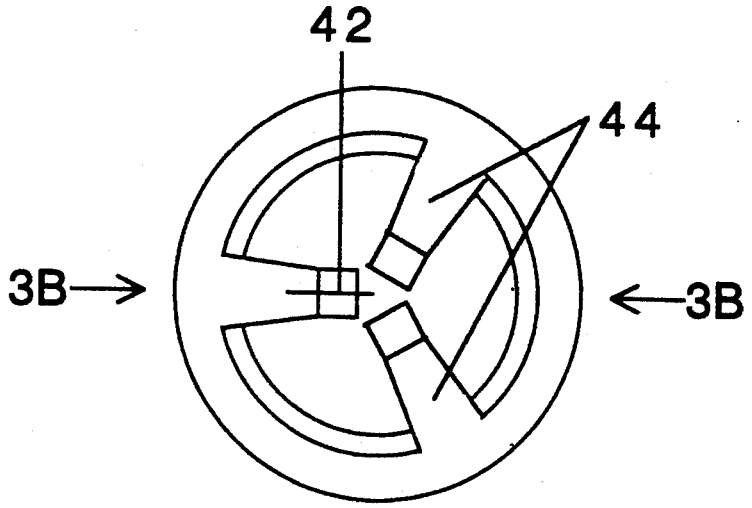
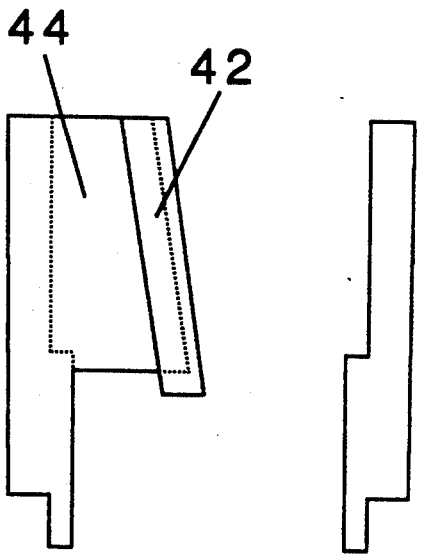
Figure 3B

MULTIPURPOSE BROADHEAD AND ARROW MAINTENANCE TOOL

TECHNICAL FIELD OF THE INVENTION

The technical field of the present invention is that of tools used with archery arrows. More particularly, the present invention is concerned with tools used to sharpen the edges of arrowheads or broadheads (sharpeners), tools used to tighten or loosen arrowheads or broadheads that are intended to be screwed onto an arrow (wrenches), and tool used to dress the conical end of an arrow where a nock is attached (dressers). Most particularly, the present invention is concerned with tools that include a sharpener, a wrench, and a dresser in a single unit that may safely be carried.

BACKGROUND INFORMATION

For a broadhead to serve its intended purpose its edge must be sharp A continuing need exists to sharpen broadheads especially since they tend to be prone to being nicked. It is desirable to be able to sharpen broadheads after they have been attached to the aluminum shaft of the arrow.

From time to time broadheads must be attached and detached from arrows by screwing or unscrewing them from the forward end of an arrow. Broadheads tend to be relatively weak to side forces. This relative weakness and their sharpness produces a need for a wrench to facilitate attachment and detachment that supports the broadhead while keeping fingers from being cut.

The portion of an arrow that receives the bowstring is the nock. The nock is usually glued onto the conical end of the arrow shaft opposite the end where the broadhead is attached (the fletched end). From time to time old nocks need to be replaced or attached. A continuing need exits for a means to dress (by removing remnants of the old guide, appropriately roughing the surface, and keeping the shape of the cone so that it conforms to the inside of the nock) the conical attachment area so that it may receive the block for effective attachment; The included angle of the conical end is expected to be twenty-two degrees.

Broadhead sharpeners are described in U.S. Pat. Nos. 3,733,933, 4,078,455, and 4,228,703. The '933 patent discloses a means for clamping a broadhead and a means for guiding a sharpening file, or the like. The '455 patent discloses a means or holding a file alongside a broadhead guide. The '703 patent discloses a holder for two parallel, touching, cylindrical files. A broadhead's edge would be sharpened by drawing it along the junction of the two files. The broadhead sharpeners disclosed by these patents are bulky and fairly heavy. A need remains in the art for a sharpener that is compact and light.

A broadhead wrench and case is described in U.S. Pat. No. 4,387,805. The disclosed wrench comprises a cylindrical housing of approximately square cross section, having a rib extending inwardly from each of the four housing walls, the inner edges of the ribs being spaced to receive the arrowhead shank. This arrangement is only optimum for broadheads having four equally spaced edges. A need remains in the art for a broadhead wrench that can readily accommodate differing arrangements of broadhead edges.

A dresser is described in U.S. Pat. No. 4,866,810, The '810 device comprises three knurled or roughened metal cylinders captively held within a metal structure and equally inclined to each other in the manner of tepee supports. Coaxial with he three inclined, roughened cylinders is an orifice for facilitating alignment of the arrow with the roughened cylinders The action of relatively rotating the cone end of an arrow against the roughened cylinders is expected to remove unwanted debris and leave circumfeential grooves. This device contains a cavity that will collect debris and is rather heavy. The roughened cylinders, after the nature of a file, tend to become clogged with debris. A need remains in the art for a dresser that is light, provides a means for removed debris readily to leave the dresser, and has an improved scraping means that tends not to clog.

A particular object of the present invention is to provide improved broadhead sharpeners, wrenches, and dressers.

A more particular object of the present invention is a light, rugged tool that combines a sharpener, wrench, and dresser in a single compact unit.

SUMMARY OF THE INVENTION

The tool is a sharpener capable of sharpening broadheads (especially those typically used in hunting), a wrench capable of tightening or loosening broadheads screwed onto an arrow, and a dresser capable of dressing the fletched end of an arrow so that the arrow effectively will receive a nock. The tool has an elongated body with integral longitudinal ridges to enhance its appearance and to facilitate gripping and is preferably molded of ABS plastic in two pieces. The sharpener and wrench are at the bottom, and the dresser is at the top of the tool. The sharpener comprises a shallow channel running diagonally across the face of the bottom, normal to the axis of the tool, with a plurality of small hard rods imbedded in the sides of the channel. Sharpening is effected by movement of the edge of a broadhead along the shallow channel. The wrench is ion the bottom of the tool and comprises a plurality of deep grooves extending radially from the axis of the tool with the deep grooves arranged so that they will receive the broadhead of an arrow that is coaxial with he tool. The dresser comprises a conical recess formed by a plurality of ribs with a hard scraping blade imbedded in one of the ribs. The blade protrudes into the recess and -preferably has a flat edge.

The tool is inherently light, strong, compact, and easy to clean. It has no separate parts that could be lost.

BRIEF DESCRIPTION OF THE DRAWINGS

FIG. 3A is a top view of the preferred embodiment showing the dresser.

FIG. 3B is a cross section of the top of the preferred embodiment showing a rib and the blade.

DETAILED DESCRIPTION OF THE INVENTION AND ITS PREFERRED EMBODIMENT

Figure 1:
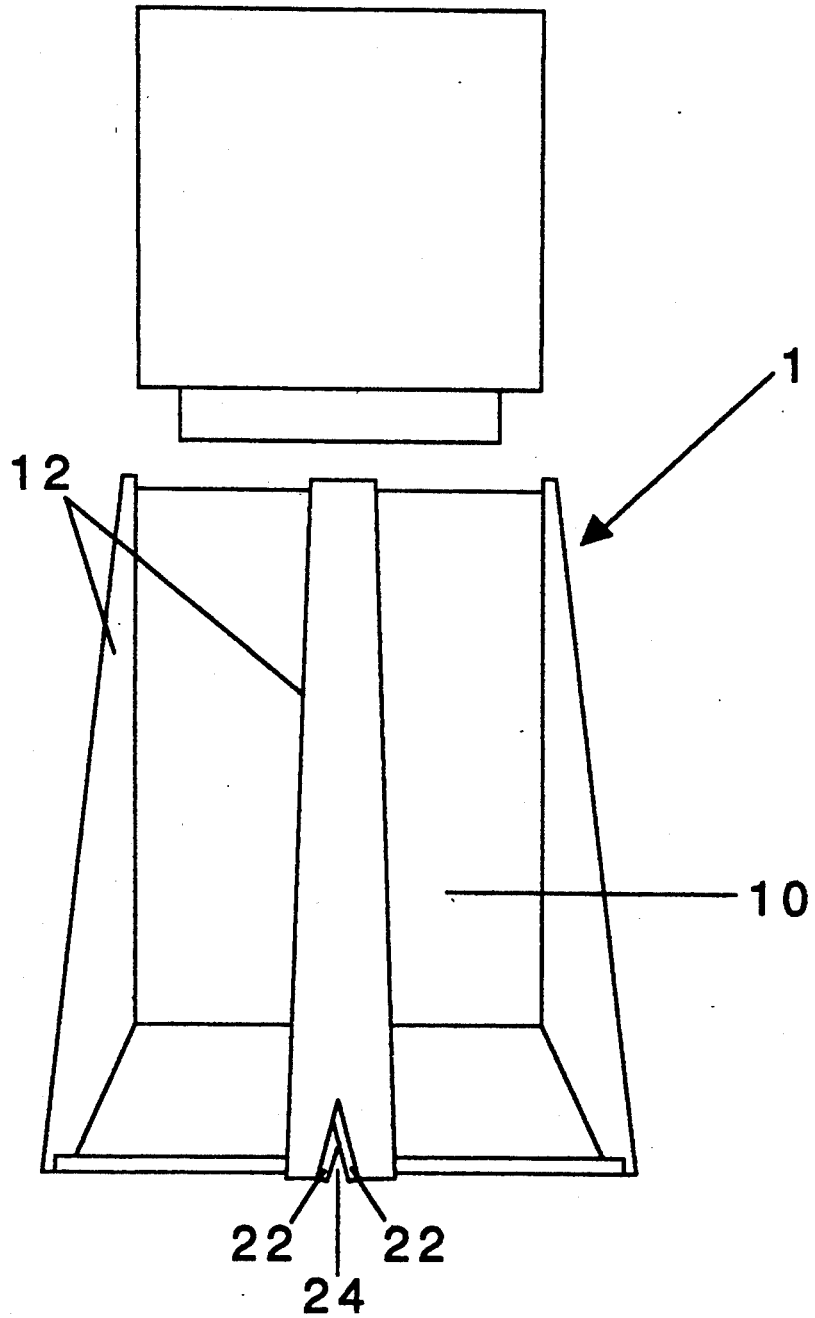
FIG. 1 is a side view of the preferred embodiment before the top and bottom are glued together.

The elongated body 10 of tool 1 is shown on FIG. 1. To facilitate griping, to enhance the strength of the tool, and to provide a pleasing appearance, it is preferred that a plurality of longitudinal ridges be spaced around body 10. The preferred embodiment has four equally spaced ridges 12. Body 10 is preferably moled from black ABS plastic in two pieces (a bottom piece containing the sharpener, wrench, and ridges, and a top piece containing the dresser) that may readily glued together to form a strong structure that a likely to survive the harsh bow hunting environment. The use of two pieces facilitates making the complex structures and shapes present at both ends of tool 1, and facilitates the production of a strong device having a minimum of mass and a device that is easy to clean because there are no cavities associated with any functional surfaces. body 10 is preferably about three inches long when assembled.

Figure 2:
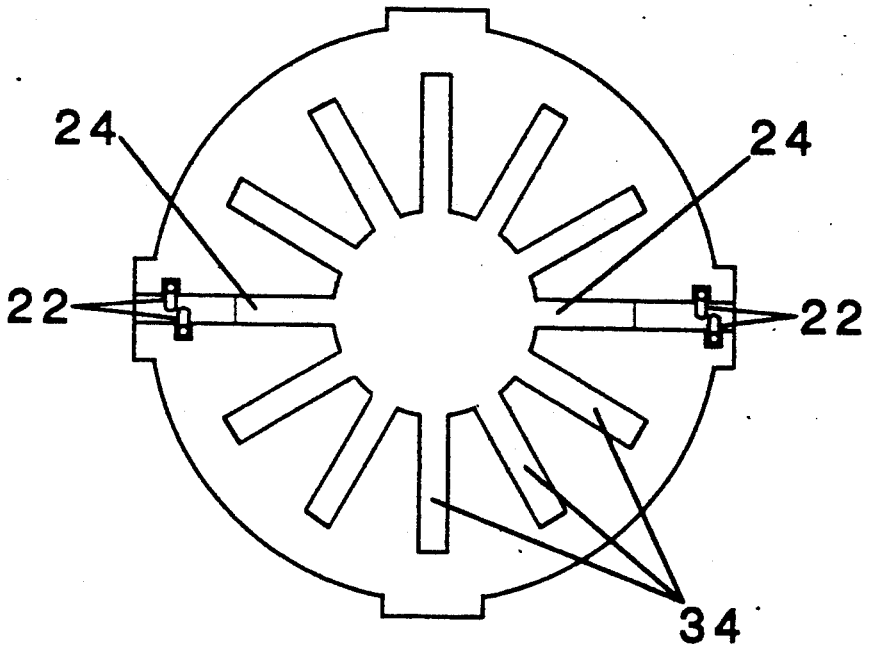
FIG. 2 is a bottom view of the preferred embodiment showing the sharpener and wrench.

The bottom of tool 1, containing the sharpener and wrench, is shown on FIG. 2. the outermost surface of the bottom of the preferred embodiment of tool 1 is flat and is essentially circular with an approximate diameter of one and a half inches. The sharpener and the wrench coexist without interference, but can not be used simultaneously.

The sharpener includes channel 24 extending diagonally across the bottom of tool 1. In the preferred embodiment, channel 24 bisects the bottom s of two of the ridges 12. Channel 24 is preferably V shaped with an included angle of 30 degrees and a depth of about 5 millimeters. This shape may be seen on FIG. 1. A pair of cylindrical sharpening rods 22 are partially imbedded in the walls of channel 24 near each end of channel 24. The major axes of rods 22 are each essentially perpendicular to the bottom of channel 24. Each rod extends from the outermost surface of the bottom of tool 1 into the bottom of channel 24 and is immediately adjacent to another rod in the facing wall of channel 24. the four rods 22 are preferably composed of a hard ceramic that is approximately 94% alumina but could usefully be composed of any hard substance such as steel or silicon carbide (Carborundum). Sharpening of a broadhead is effected by rods 22 abrading the edge of the broadhead.

The wrench includes a set of grooves 34 emanating radially rom an opening along the center axis of tool 1. In the preferred embodiment of the present invention, grooves 34 are spaced 30 degrees apart with two of grooves 34 in line with channel 24. Thus, in the preferred embodiment, there are a total to twelve grooves 34 and broadheads with two, three, four, six, or twelve equally spaced edges may readily be accommodated. The grooves 34 are preferably between 2 and 3 millimeters wide and deep enough to accommodate broadheads. A central opening is provided to accommodate the shaft of an arrow The opening is preferably circular and about 14 millimeters in diameter.

The top of tool 1 contains the dresser and is shown on FIG. 3A and FIG. 3B. The dresser includes supporting ribs 44 and dressing blade 42 imbedded none rib. The preferred embodiment of the present invention has three ribs 44, though more ribs or mother structures could be used to support an inserted arrow end. The ribs 44 each preferably have a face width of about 4 millimeters, a depth of about 0.;62 inches (15.7 millimeters), and a flat face that is inclined eleven degrees with respect to the major axis of tool 1. The ribs 44 effect a conical recess, for the end of the arrow to be dressed, having an included angle of 22 degrees. One rib is molded with a narrow, constant depth groove running longitudinally through the middle of its face Blade 42 is held captive in the groove with preferredly approximately one millimeter uniformly protruding from the groove. In the preferred embodiment, blade 42 is composed of a flat, rectangular piece of hardened 1090 type steel about 0.71 inches (18 millimeters) long, however any substance that is hard with respect to the aluminum of the typical arrow shaft might be used. The protruding part of blade 42 preferredly comprises two 90 degree edges, herein referred to as a flat edge (rather than a chisel-like edge), thus facilitating the dressing function with both clockwise and counter-clockwise rotation of he arrow to be dressed. While the preferred embodiment of the present inventing has one blade 42, the present invention encompasses a plurality of blades.

The preferred embodiment of the present invention has been described as a tool including a ridged, elongated body, a sharpener, a wrench, and a dresser. Alternative embodiments of the present invention encompass a tool including only tow of he described sharpener, wrench, and dresser. Such alternative embodiments look like FIGS. 1 through 3 with a sharpener, wrench, or dresser absent.

Figure 4:
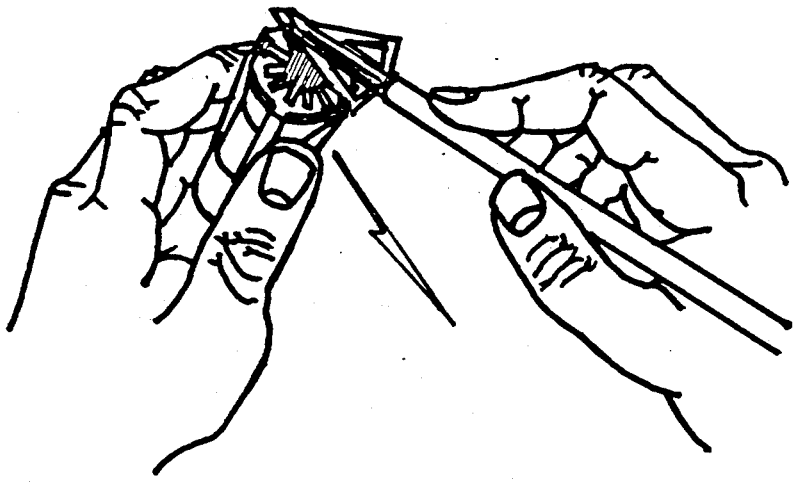
FIG. 4 is a perspective view of an arrow and the preferred embodiment being used as a sharpener.

The method of using the preferred embodiment of the present invention are illustrated in FIGS. 4 (a sharpener), 5 (a wrench), and 6 (a dresser). The illustrations and the following descriptions of the use of the preferred embodiment are form eh view of a right-handed person. Directions would be reversed for a left-handed person.

FIG. 4 shows tool 1 held in the left hand and the broadhead end of an arrow held in the right hand. The bottom of the tool is facing generally upward. Channel 24 is aligned to run in the same direction as the arrow, and the broad head is sharpened by drawing its edges, one at a time, through the channel and across one or more sets of rods. A pointer on FIG. 4 indicates the preferred direction to draw the broadhead's edge.

Figure 5:
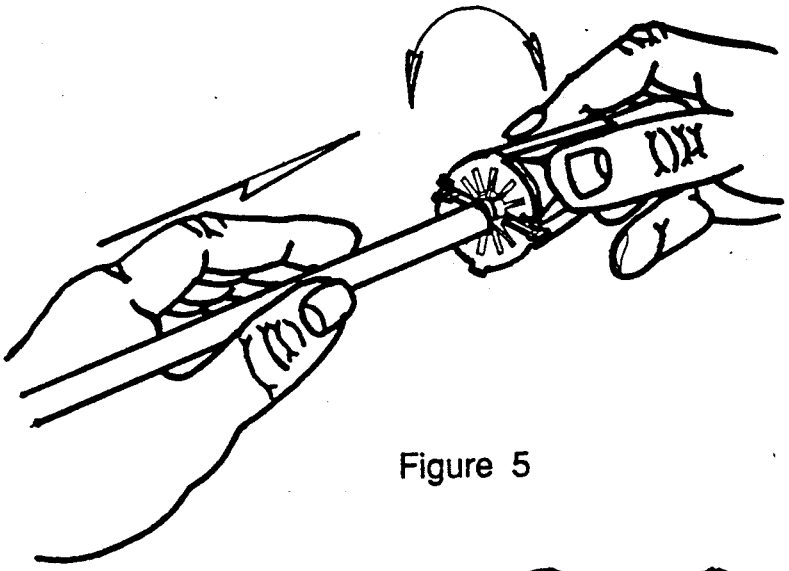
FIG. 5 is a perspective view of an arrow and the preferred embodiment used as a wrench.

FIG. 5 shows tool 1 held in the right hand ad the broadhead end of an arrow held in the left hand with the shaft of the arrow coaxial with the tool. The bottom of the tool is facing generally to the left. The single-ended pointer of FIG. 5 indicates the direction the arrow is moved so as to insert the broadhead into the wrench. The double-ended pointer on FIG. 5 indicates that the wrench may be rotated in either direction to effect tightening or loosening of the broadhead on the shaft of eh arrow.

Figure 6:
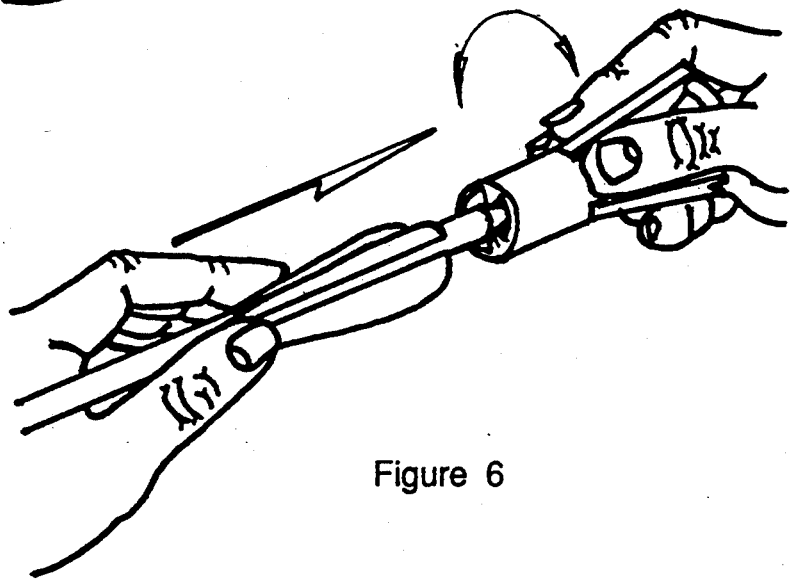
FIG. 6 is a perspective view of an arrow and the preferred embodiment used as a dresser.

FIG. 6 shows tool 1 held in the right hand and the fletched end of an arrow held in the left hand with the shaft of the arrow coaxial with he tool. The top of the tool is facing generally to the left. The single-ended pointer of FIG. 6 indicates the direction the arrow is moved so as to insert the conical end of the arrow into the dresser. The double-ended pointer on FIG. 6 indicates that the wrench may be rotated in either direction toe effect dressing the conical end of the arrow shaft.

The preferred embodiment of the present invention, and its method so use, has been described in detail. Alternative embodiment have been described. The embodiments described are illustrative and not restrictive.

We claim:

1. A tool, for use with an archery arrow having a broadhead attached on one end and being formed into a cone at the other end, comprising:

an elongated body having a top, a bottom, and a central axis;

sharpener means embedded in said bottom for sharpening the broadhead;

wrench means formed in said bottom for receiving the broadhead; and dresser means formed in said top for dressing the cone.

2. A tool as described in claim 1, wherein said elongated body has a plurality of longitudinal ridges.

3. A tool as described in claim 1, wherein said sharpener means includes a plurality of inclined rods of material harder than the material of the broadhead.

4. A tool as described in claim 3, wherein said rods are on the walls of a channel extending across the bottom of said body.

5. A tool as described in claim 3, wherein said rods are composed of a material selected from the group consisting of ceramic, steel, and silicon carbide.

6. A tool as described in claim 1, wherein said wrench means includes a plurality of deep grooves extending radially from said axis.

7. A tool as described in claim 6, wherein said wrench means includes twelve equally spaced grooves.

8. A tool as described in claim 1, wherein said dresser means includes:

a conical recess formed from a plurality of ribs shaped to receive the cone; and one or more hard blades embedded in said ribs, said blades having an edge protruding into said recess.

9. A tool as described in claim 8, wherein at least one of said blades has a flat edge.

10. A tool, for use with an archery arrow having a broadhead attached on one end and being formed into a cone at the other end, comprising:

an elongated body having a plurality of longitudinal ridges, a top, a bottom, and a central axis;

a broadhead sharpener embedded in said bottom having a plurality of inclined rods of material harder than the material of the broadhead;

wrench means formed in said bottom for receiving the broadhead; and dresser means formed in said top for dressing the cone.

11. A tool as described in claim 10, wherein said rods are on the walls of a channel extending across the bottom of said body.

12. A tool as described in claim 10, wherein said rods are composed of a material selected from the group consisting of ceramic, steel, and silicon carbide.

13. A tool as described in claim 10, wherein said wrench means includes a plurality of deep grooves extending radially from said axis.

14. A tool as described in claim 10, wherein said dresser means includes:

a conical recess formed from a plurality of ribs shaped to receive the cone; and one or more hard blades embedded in said ribs, said blades having an edge protruding into said recess.

15. A tool as described in claim 14, wherein at least one of said blades has a flat edge.

16. A tool, for use with an archery arrow having a broadhead attached on one end and being formed into a cone at the other end, comprising:

an elongated body having a plurality of longitudinal ridges, a top, a bottom, and a central axis;

a broadhead sharpener embedded in said bottom, said sharpener having a plurality of inclined rods of material harder than the material of the broadhead; and a cone dresser formed in said top, said dresser including:

a conical recess formed from a plurality of ribs shaped to receive the cone, and one or more hard blades embedded in said ribs, said blades having an edge protruding into said recess.

17. A tool as described in claim 16, wherein said rods are on the walls of a channel extending across the bottom of said body.

18. A tool as described in claim 16, wherein said rods are composed of a material selected from the group consisting of ceramic, steel, and silicon carbide.

19. A tool as described in claim 16, further including:

wrench means formed in said bottom for receiving the broadhead.

20. A tool as described in claim 16, wherein at least one of said blades has a flat edge.

* * * * *